US007202414B2

(12) United States Patent
Johnson

(10) Patent No.: US 7,202,414 B2
(45) Date of Patent: Apr. 10, 2007

(54) APPARATUS AND METHOD FOR MANIPULATING A LINE SUCH AS A CABLE OR CORD

(76) Inventor: Jason G. Johnson, 7453 Singing Tree St., Las Vegas, NV (US) 89123

( * ) Notice: Subject to any disclaimer, the term of this patent is extended or adjusted under 35 U.S.C. 154(b) by 94 days.

(21) Appl. No.: 11/062,721

(22) Filed: Feb. 22, 2005

(65) Prior Publication Data

US 2006/0185873 A1 Aug. 24, 2006

(51) Int. Cl.
*H01B 7/34* (2006.01)

(52) U.S. Cl. ..... 174/36

(58) Field of Classification Search ..... 174/36, 174/110 R, 111, 112, DIG. 9
See application file for complete search history.

(56) References Cited

U.S. PATENT DOCUMENTS 1,179,700 A 4/1916 Cornell
1,708,165 A 4/1929 Willat
2,072,387 A * 3/1937 Sneed ..... 87/6
2,143,649 A * 1/1939 Dansard ..... 174/69
2,160,961 A 6/1939 Dorman
3,014,087 A * 12/1961 Kaplan et al. ..... 174/69
3,068,316 A 12/1962 Witt
3,126,442 A * 3/1964 Roberts ..... 174/69
3,277,231 A * 10/1966 Downey et al. ..... 174/47
3,353,817 A * 11/1967 Bollinger ..... 267/69
4,992,629 A 2/1991 Morais
5,744,218 A 4/1998 Barnes
6,513,210 B1 * 2/2003 Gonzalez ..... 24/712

OTHER PUBLICATIONS

International Search Report issued on Aug. 16, 2006, by the ISA/US, in connection with International Application No. PCT/US2006/005563.
Written Opinion of the International Searching Authority Issued on Aug. 16, 2006, by the ISA/US, in connection with Internatlonal Application No. PCT/US2006/005563.

* cited by examiner

*Primary Examiner*—William H. Mayo, III
(74) *Attorney, Agent, or Firm*—Haynes and Boone, LLP

(57) ABSTRACT

Apparatus and method according to which a line extends through a sleeve so that a first amount of the line is disposed within the sleeve. After stretching and permitting the sleeve to retract, a second amount of the line is disposed within the sleeve, with the second amount being greater than the first amount.

26 Claims, 5 Drawing Sheets

34
16
16a
16b
18
20
36a
36b
38a
38b
40
42
44

APPARATUS AND METHOD FOR MANIPULATING A LINE SUCH AS A CABLE OR CORD

BACKGROUND

This invention relates in general to an apparatus and method for manipulating a line such as a cable or cord, with the manipulation including but not limited to storing, packaging or collapsing the line, or fully or variably extending the line from a sleeve, sheath, tubing or the like, or any combination thereof.

BRIEF SUMMARY OF THE INVENTION

According to one aspect of the present disclosure, an apparatus is provided that includes a sleeve defining a passage through which a line is adapted to extend, the passage defining an internal surface of the sleeve; wherein the sleeve comprises a first configuration in which the sleeve has a first length, and a first amount of the line is disposed within the passage when the line extends through the passage; a second configuration in which the sleeve has a second length wherein the second length is greater than the first length; and a third configuration in which the line extends through the sleeve and at least a portion of the internal surface of the sleeve engages at least a portion of the line, and a second amount of the line is disposed within the passage wherein the second amount of the line is greater than the first amount of the line.

According to another aspect of the present disclosure, a method is provided that includes extending a line through a sleeve having a first length so that a first amount of the line is disposed within the sleeve: stretching the sleeve to a second length that is greater than the first length; and permitting the sleeve to retract to a third length that is less than the second length so that a second amount of the line is disposed within the sleeve wherein the second amount is greater than the first amount.

According to another aspect of the present disclosure, an apparatus is provided that includes an elastic sleeve adapted to be stretched and permitted to retract, and through which a line is adapted to extend so that a first amount of the line is disposed within the elastic sleeve before the elastic sleeve is stretched and permitted to retract; wherein, when the line extends through the elastic sleeve and after the elastic sleeve stretches and retracts, a second amount of the line is disposed within the elastic sleeve wherein the second amount is greater than the first amount.

DETAILED DESCRIPTION

Figure 1A:
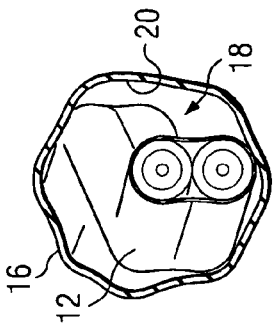
FIG. 1*a* is a sectional view of the apparatus of FIG. 1 taken along line 1A—1A.
Figure 1:
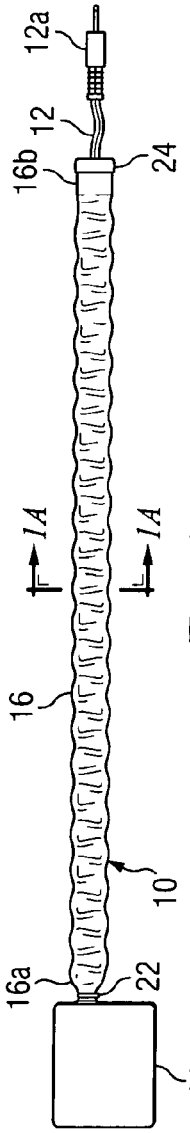
FIG. 1 is an elevation view of an apparatus according to an embodiment of the present invention.

Referring to FIGS. 1 and 1*a*, an apparatus according to an embodiment of the present invention is generally referred to by the reference numeral 10, and is engaged with a line in the form of a conventional cable 12 extending from an electronic device in the form of a power adapter 14. A plug element 12*a* is connected to the distal end of the cable 12.

The apparatus 10 includes a sleeve 16 defining a passage 18 through which the cable 12 extends. The sleeve 16 is in the form of an elastic sleeve and is adapted to stretch and retract under conditions to be described. An internal surface 20 of the sleeve 16 is defined by the passage 18, and at least a portion of the internal surface 20 is engaged with at least a portion of the cable 12.

A clip 22 extends at least partially circumferentially about an end portion 16*a* of the sleeve 16 and the proximal end portion of the cable 12 disposed within the end portion 16*a* of the sleeve 16, clamping the end portion 16*a* of the sleeve 16 against the proximal end portion of the cable 12 and thereby substantially fixing the end portion 16*a* of sleeve 16 relative to the cable 12. It is understood that the proximal end portion of the cable 12 may include a conventional strain relief that may promote the clamping of the end portion 16*a* of the sleeve 16 against the proximal end portion of the cable 12.

A fitting 24 is generally in the form of an annular member through which the cable 12 extends and is partially inserted into the passage 18 at an end portion 16*b* of the sleeve 16 so that the sleeve 16 grips the fitting, thereby connecting and securing the fitting 24 to the sleeve 16. It is understood that additional connecting means may be used to further secure the fitting 24 to the sleeve 16 such as, for example, adhesive disposed between the fitting 24 and the internal surface 20 of the sleeve 16.

In operation, the sleeve 16 may be in the configuration depicted in FIGS. 1 and 1*a*, with the sleeve 16 in a crumpled condition and large amount, or the majority, of the cable 12 at least partially crumpled and disposed within the passage 18. The internal surface 20 of the sleeve 16 engages the cable 12 at several points along the longitudinal length of the sleeve 16 so that at least portions of the sleeve 16 conform to and/or grip the corresponding portions of the cable 12, thereby resisting relative movement between the sleeve 16 and the cable 12. Such relative movement may include unwanted travel of the cable 12 through the fitting 24 and out of the passage 18 of the sleeve 16.

Figure 2:
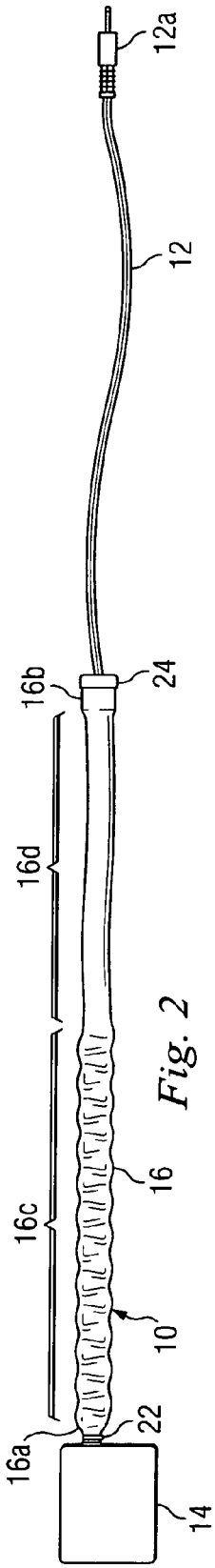
FIG. 2 is an elevation view of the apparatus of FIG. 1 but depicting another configuration.

If required and/or desired, the sleeve 16 may then be placed in the configuration depicted in FIG. 2 by moving the plug element 12*a* in a direction away from the fitting 24, thereby reducing the amount of the cable 12 disposed within the passage 18 and defining a crumpled portion 16*c* and a relaxed portion 16*d* of the sleeve 16. The longitudinal lengths of the crumpled portion 16*c* and the relaxed portion 16*d* are dependent upon the amount of the portion of the cable 12 that moved out from the passage 18 of the sleeve 16. That is, as the plug element 12*a* is moved away from the fitting 24, the cable 12 also travels through the fitting 24 and out of the passage 18 of the sleeve 16. As the cable 12 so travels, the cable 12 disengages from the corresponding portions of the internal surface 20 of the sleeve 16 so that the corresponding portions of the sleeve 16 no longer conform to and/or grip the cable 12, thereby defining the longitudinal length of the relaxed portion 16*d* of the sleeve 16. The longitudinal length of the crumpled portion 16*c* of the sleeve 16 is, in turn, defined by the longitudinal length of the relaxed portion 16*d* of the sleeve 16.

As much of the cable 12 as is necessary and/or desired may be moved out from the passage 18 of the sleeve 16 for any desired reason such as, for example, initiating conventional operation of the power adapter 14 by inserting the plug element 12*a* into a receptacle (it is understood that the power adapter 14 may be plugged into a conventional power outlet to effect this conventional operation). The crumpled portion 16*c* of the sleeve 16 continues to conform to and/or grip portions of the cable 12, thereby continuing to resist relative movement between the sleeve 16 and the cable 12 so that the desired amount of the cable 12 extending outside of the passage 18 remains substantially constant.

Figure 3:
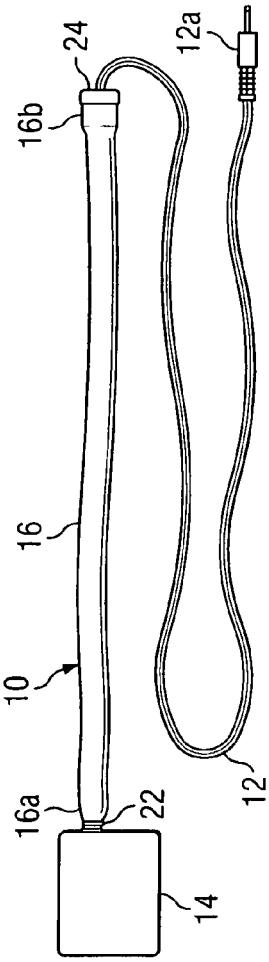
FIG. 3 is an elevation view of the apparatus of FIG. 1 but depicting another configuration.

If required and/or desired, the sleeve 16 may then be placed in the configuration depicted in FIG. 3 by continuing to move the plug element 12*a* in a direction away from the fitting 24 so that a minimum amount of the cable 12 is disposed within the passage 18 and a maximum amount of the cable 12 extends outside of the passage 18. As shown in FIG. 3, no portion of the sleeve 16 between the end portions 16*a* and 16*b* conforms to and/or grips any portion of the cable 12 and thus the entire length of the sleeve 16 extending between the end portions 16*a* and 16*b* is in a relaxed condition.

In view of the foregoing, it is understood that the amount of the cable 12 disposed within the passage 18 of the sleeve 16 may be varied as desired or as dictated by environmental constraints such as, for example, the position of the conventional power outlet to which the power adapter 14 is connected and the position of the receptacle into which the plug element 12*a* is inserted during the operation of the power adapter 14. As the amount of the cable 12 disposed within the passage 18 of the sleeve 16 is varied, the amount of the cable 12 extending outside of the passage 18 is correspondingly varied.

Figure 4:
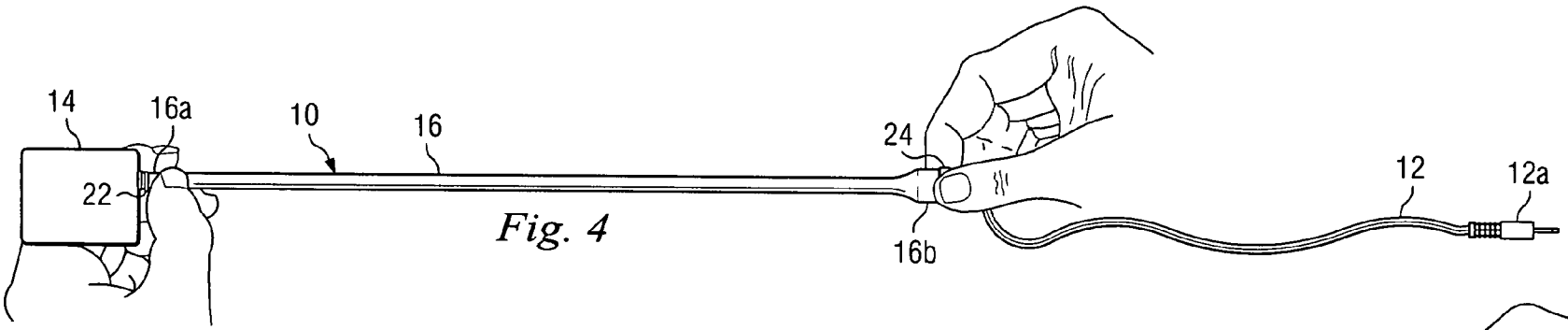
FIG. 4 is an elevation view of the apparatus of FIG. 1 but depicting another configuration.

The sleeve 16 may be placed in the configuration depicted in FIG. 4 by grasping the fitting 24 and/or the end portion 16*b* of the sleeve 16 and moving same in a direction away from the clip 22 and the power adapter 14, with the position of the end portion 16*a* of the sleeve 16 and the clip 22 clamped therearound remaining substantially constant, thereby increasing the length of and stretching the sleeve 16 over the cable 12. Thus, an increased amount of the cable 12 is disposed within the passage 18 of the sleeve 16, in comparison to the amount of the cable 12 disposed within the passage 18 of the sleeve 16 in the configuration of FIG. 3. Moreover, due to the stretching of the sleeve 16, the cross-sectional area of the passage 18 of the sleeve 16 in the configuration of FIG. 4, at one or more locations along the longitudinal length of the sleeve 16, is less than the cross-sectional area of the passage 18 of the sleeve 16 in the configuration of FIG. 3, at the corresponding one or more locations along the longitudinal length of the sleeve 16.

Figure 5:
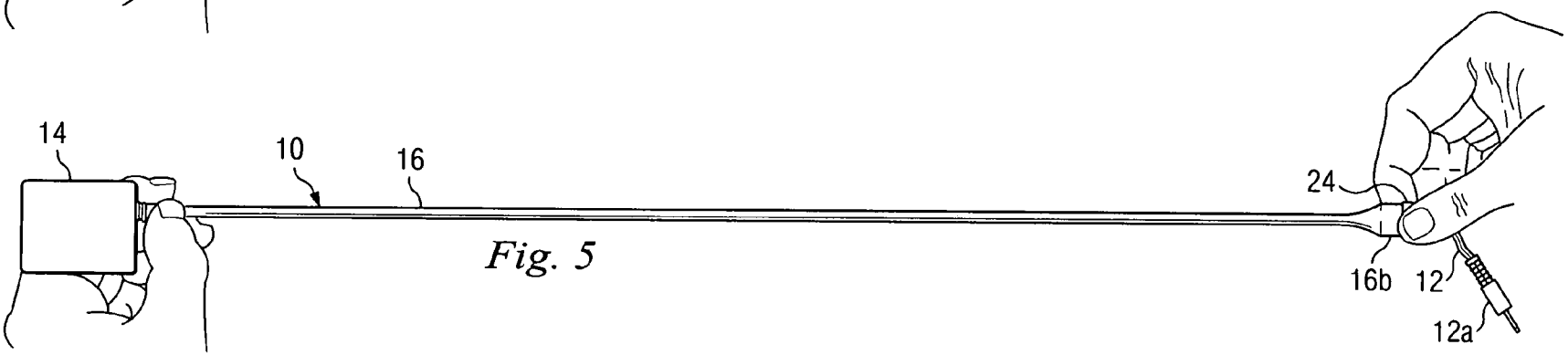
FIG. 5 is an elevation view of the apparatus of FIG. 1 but depicting another configuration.

The sleeve 16 may be placed in the configuration depicted in FIG. 5 by continuing to stretch the sleeve 16 over the cable 12 so that length of the sleeve 16 continues to increase and an increased amount of the cable 12 is disposed within the passage 18 of the sleeve 16, in comparison to the amount of the cable 12 disposed within the passage 18 of the sleeve 16 in the configuration of FIG. 4. Moreover, due to the additional stretching of the sleeve 16, the cross-sectional area of the passage 18 of the sleeve 16 in the configuration of FIG. 5, at one or more locations along the longitudinal length of the sleeve 16, is less than the cross-sectional area of the passage 18 of the sleeve 16 in the configuration of FIG. 4, at the corresponding one or more locations along the longitudinal length of the sleeve 16.

It is understood that the sleeve 16 may be stretched so that the fitting 24 is at any desired location along the longitudinal length of the cable 12 between the position of the fitting 24 as depicted in FIG. 3 and the plug element 12*a* of the cable 12.

Figure 6:
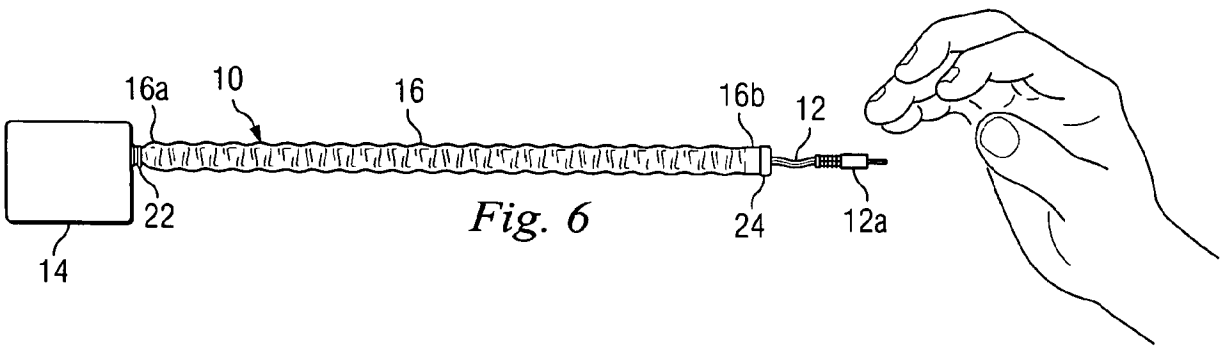
FIG. 6 is an elevation view of the apparatus of FIG. 1 in a configuration substantially similar to the configuration of FIG. 1.

The sleeve 16 may be placed in the configuration depicted in FIG. 6 by permitting the sleeve 16 to retract so that the fitting 24 moves from the position shown in FIG. 5 to the position shown in FIG. 6 and the length of the sleeve 16 decreases. During retraction, at least a portion of the internal surface 20 of the sleeve 16 engages at least a portion of the cable 12 so that the sleeve 16 at least partially conforms to and/or grips the portion of the cable 12. This engagement may occur due to the above-described reduction in the cross-sectional area of the passage 18 of the sleeve 16 in the stretched configuration of FIG. 5, which positions the internal surface 20 closer to the cable 12 and thereby enables the internal surface 20 to engage the cable 12. In the alternative, the sleeve 16 may be pinched or pressed against the cable 12 so that the internal surface 20 engages the cable 12.

Due to the engagement between the internal surface 20 and the cable 12, the portion of the cable 12 disposed within the passage 18 in the stretched configuration of FIG. 5 remains within the passage 18 as the sleeve 16 is permitted to retract. Since the overall length of the sleeve 16 decreases during the retraction, and the amount of the cable 12 within the passage 18 remains substantially constant, the internal surface 20 applies a force to the cable 12 to at least partially collapse, bunch together and/or crumple the cable 12 within the passage 18 of the sleeve 16 during the retraction of the sleeve 16.

As the cable 12 at least partially collapses, bunches together and/or crumples within the passage 18, the internal surface 20 engages the cable 12 at multiple points along the length of the sleeve 16 so that the sleeve 16 grips and/or conforms to the cable 12 at these points, further promoting the collapse of the cable 12. Moreover, these engagements may serve to assist in the prevention of unwanted tangling of the cable 12 within the passage 18 by causing the cable 12 to collapse in a uniform manner. For example, the cable 12 may collapse so that the cable 12 forms a spiral or a reversing loop. For another example, the cable 12 may collapse in an "accordion-type" manner. It is understood that, in some cases, the cable 12 may collapse in a uniform manner, a non-uniform manner or a combination thereof. It is further understood that several factors may affect the uniformity of the collapse including but not limited to the dimensions and/or stiffness of the cable 12. Moreover, it is understood that the collapse of the cable 12 in a uniform manner may maximize the degree of collapse of the cable 12 and/or the cable 12's ability to easily travel out from the passage 18.

It is understood that length of the sleeve 16 in the configuration of FIG. 6 may range from a length equal to about the length of the sleeve in the configuration of FIG. 3 to a length slightly less than the length of the sleeve in the configuration of FIG. 5. Further, it is understood that the sleeve 16 is able to retract due to its elasticity and its being stretched within its elastic regime, in which case the deformation that the sleeve 16 experiences during stretching is not permanent. Still further, it is understood that the sleeve 16 may be permitted to retract in a variety of ways such as, for example, by grasping the end portion 16*b* and/or the fitting 24 and guiding the sleeve 16 back to its relaxed configuration, or by letting go of the sleeve 16 and allowing the sleeve 16 to snap back to its relaxed configuration from its stretched configuration.

As a result of its retraction, the sleeve 16 now stores and retains a large amount, or a majority, of the cable 12 within the passage 18, and the cable 12 may be easily pulled out of the sleeve 16 as required and/or desired.

Figure 7:
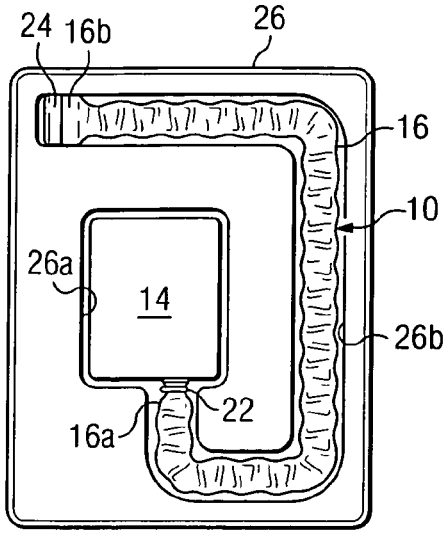
FIG. 7 is an elevation view of the apparatus of FIG. 1 but depicting another operational mode.

Referring to FIG. 7, the power adapter 14 is packaged in a container 26, with the power adapter 14 disposed in a cavity 26*a* formed in the container 26. The cable 12 is packaged in the sleeve 16 in a manner similar to that discussed above in connection with the configuration of FIG. 6, and the cable 12 and the sleeve 16 are disposed in a channel 26*b* formed in the container. Thus, the sleeve 16 functions as packaging for the cable 12, and it is understood that the sleeve 16 may be used as a substitute for twisty ties, plastic bags and/or other conventional means for packaging lines such as cables.

Figure 8:
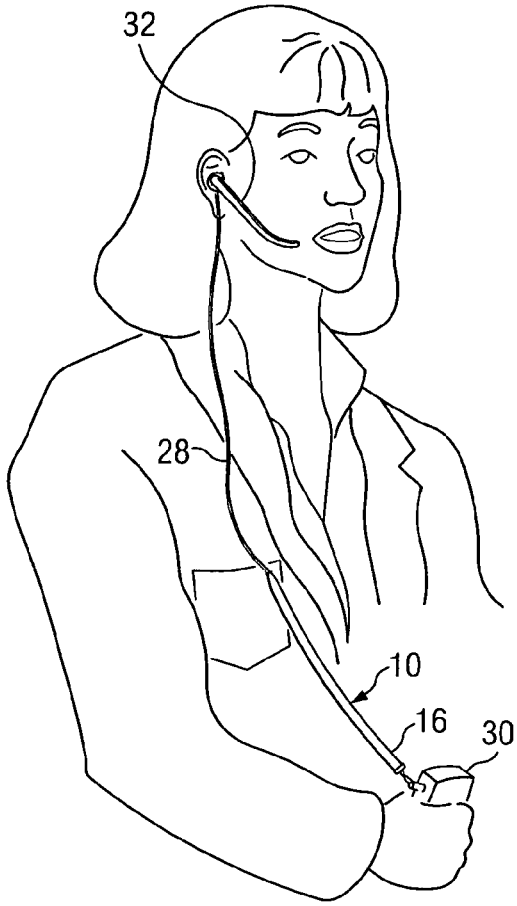
FIG. 8 is a perspective view of the apparatus of FIG. 1 but depicting another operational mode.

Referring to FIG. 8, another application for the apparatus 10 is depicted, with a hands-free cable 28 extending from a cell phone 30 and through the sleeve 16. As shown in FIG. 8, the sleeve 16 is in a relaxed configuration that is substantially similar to the configuration of FIG. 3, with a minimum amount of the cable 28 disposed within the passage 18 of the sleeve 16, thereby enabling unencumbered use of a hands-free headset 32 connected to the distal end of the cable 28.

Figure 9:
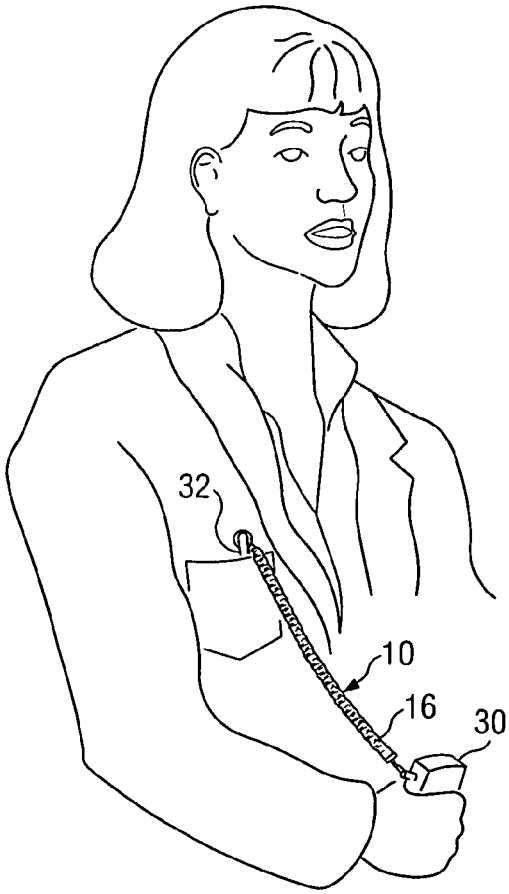
FIG. 9 is a perspective view of the apparatus of FIG. 8 but depicting another configuration.

Referring to FIG. 9, when the hands-free headset 32 is not in use, the sleeve 16 may be placed in a retracted configuration in a manner similar to the operation described above in connection with FIGS. 3–6. As shown in FIG. 9, the sleeve 16 is in a retracted configuration that is substantially similar to the retracted configuration of FIG. 6, with a maximum amount of the cable 28 disposed within the passage 18 of the sleeve 16. Since the sleeve 16 assists in preventing the cable 28 from becoming entangled as described above in connection with the configuration of FIG. 6, the cable 28 may easily be stored in a small space such as, for example, a shirt pocket. When it is desired to again use the hands-free headset 32, the sleeve 16 may again be placed in the relaxed configuration of FIG. 8 in a manner similar to the operation described above in connection with FIGS. 1–3. Thus, the sleeve 16 functions as a storage device for the cable 28.

In addition to cables for hands-free accessories for cell phones, such as headsets and ear pieces, it is understood that the sleeve 16 may function as a storage device for a wide variety devices from which one or more lines extend such as, for example, cables for MP3 and digital music players. For devices with cables extending from left and right ear pieces or the like, the prevention of entanglement between the left and right cables by the sleeve 16 in its retracted configuration is especially helpful.

Referring to FIGS. 10*a* through 10*d*, an apparatus according to another embodiment of the present invention is generally referred to by the reference numeral 34. The embodiment of FIGS. 10*a* through 10*d* is similar to the embodiment of FIGS. 1 through 9 and contains several parts of the embodiment of FIGS. 1 through 9 which are given the same reference numerals. In the embodiment of FIGS. 10*a* through 10*d*, a pair of splices 36*a* and 36*b* are formed at the end portion 16*a* of the sleeve 16, and a pair of splices 38*a* and 38*b* are formed at the end portion 16*b* of the sleeve 16.

In operation, with continuing reference to FIGS. 10*a* through 10*d*, a line such as a cable 40 is inserted into the passage 18 of the sleeve 16 so that the cable 40 extends through the passage 18. It is understood that the presence of the splices 36*a*, 36*b*, 38*a* and 38*b* may facilitate the cable 40's insertion into and extension through the passage 18 of the sleeve 16. A knot 42 is formed by tying the splices 36*a* and 36*b* together, and a knot 44 is formed by tying the splices 38*a* and 38*b* together. It is understood that the knots 42 and 44 may somewhat limit relative movement between the sleeve 16 and the cable 40 by reducing the gap between the cable 40 and the internal surface 20 of the sleeve 16.

Figures 10A, 10B, 10C, 10D:
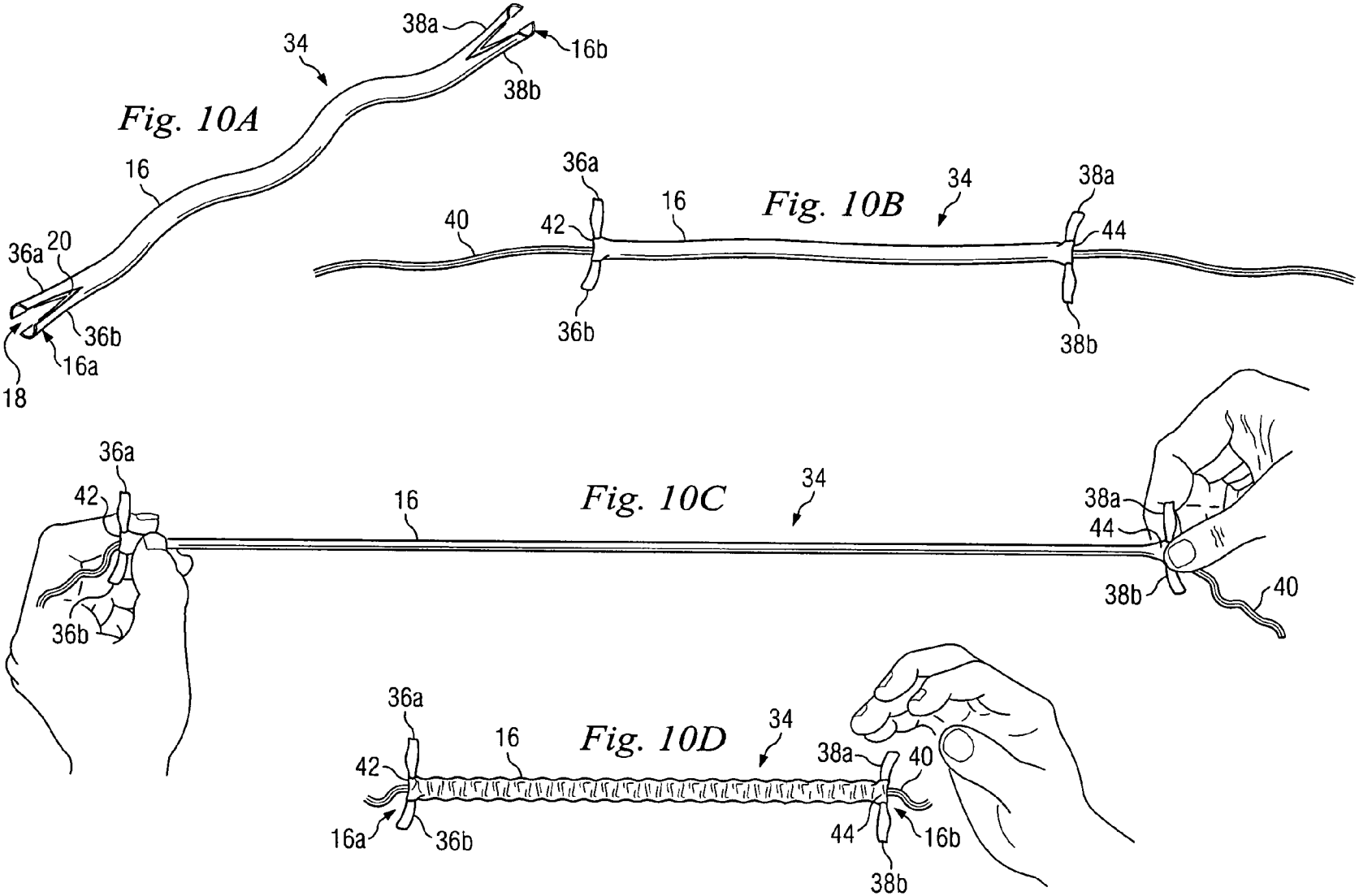
FIG. 10*a* is a perspective view of an apparatus according to another embodiment of the present invention.
FIG. 10*b* is an elevation view of the apparatus of FIG. 10*a* but depicting another configuration.
FIG. 10*c* is an elevation view of the apparatus of FIG. 10*a* but depicting another configuration.
FIG. 10*d* is an elevation view of the apparatus of FIG. 10*a* but depicting another configuration.

Upon insertion and extension of the cable 40 through the passage 18 of the sleeve 16, and the forming of the knots 42 and 44, the sleeve 16 is in the configuration depicted in FIG. 10*b*. The sleeve 16 may be placed in the configuration depicted in 10*c* by grasping the knots 42 and 44 and pulling the knots 42 and 44 away from each other, thereby stretching the sleeve 16 and increasing the length thereof so that an increased amount of the cable 40 is disposed within the passage 18 of the sleeve 16, in comparison to the amount of the cable 40 disposed within the passage 18 of the sleeve 16 in the configuration of FIG. 10*b*.

Moreover, due to the stretching of the sleeve 16, the cross-sectional area of the passage 18 of the sleeve 16 in the configuration of FIG. 10*c*, at one or more locations along the longitudinal length of the sleeve 16, is less than the cross-sectional area of the passage 18 of the sleeve 16 in the configuration of FIG. 10*b*, at the corresponding one or more locations along the longitudinal length of the sleeve 16.

The sleeve 16 may be placed in the configuration depicted in FIG. 10*d* by permitting the sleeve 16 to retract so that the knots 42 and 44 move toward each other. During retraction, at least a portion of the internal surface 20 of the sleeve 16 engages at least a portion of the cable 40 so that the sleeve 16 at least partially conforms to and/or grips the portion of the cable 40. This engagement may occur due to the above-described reduction in cross-sectional area of the passage 18 of the sleeve 16 in the stretched configuration of FIG. 10*c*, which positions the internal surface 20 closer to the cable 40 and thereby enables the internal surface 20 to engage the cable 40. In addition, or in the alternative, the engagement may occur due to the above-described reduction in the gap between the cable 40 and the sleeve 16 due to the knots 42 and 44, which positions the internal surface 20 closer to the cable 40 to thereby enable the internal surface 20 to engage the cable 40. In addition, or in the alternative, the sleeve 16 may be pinched or pressed against the cable 40 so that the internal surface 20 engages the cable 40.

The engagement between the internal surface 20 and the cable 40 occurs at at least two locations along the longitudinal length of the sleeve 16, with one of the locations between the center of the sleeve 16 and the knot 42, and the other of the locations between the center of the sleeve 16 and the knot 44. Due to these engagements, the portion of the cable 40 disposed within the passage 18 in the stretched configuration of FIG. 10*c* remains within the passage as the sleeve 16 is permitted to retract. Since the overall length of the sleeve 16 decreases during the retraction, and the amount of the cable 40 within the passage 18 remains substantially constant, the internal surface 20 applies a force at each of the at least two locations of engagement between the internal surface 20 and the cable 40 to at least partially collapse, bunch together and/or crumple the cable 40 within the passage 18 of the sleeve 16 during the retraction of the sleeve 16. As the cable 40 at least partially collapses, bunches together and/or crumples within the passage 18, the internal surface 20 engages the cable 12 at an increased number of locations along the length of the sleeve 16 so that the sleeve 16 grips and/or conforms to the cable 40 at these locations, further promoting the collapse of the cable 12.

Moreover, these engagements may serve to assist in the prevention of unwanted tangling of the cable 12 within the passage 18 by causing the cable 40 to collapse in uniform manner. For example, the cable 40 may collapse so that the cable 40 forms a spiral or a reversing loop. For another example, the cable 40 may collapse in an "accordion-type" manner. It is understood that, in some cases, the cable 40 may collapse in a uniform manner, a non-uniform manner or a combination thereof. It is further understood that several factors may affect the uniformity of the collapse including but not limited to the dimensions and/or stiffness of the cable 40. Moreover, it is understood that the collapse of the cable 40 in a uniform manner may maximize the degree of collapse of the cable 40 and/or the cable 40's ability to easily travel out from the passage 18, via the end portion 16*a* and/or 16*b*.

It is understood that the sleeve 16 is able to retract due to its elasticity and its being stretched within its elastic regime, in which case the deformation that the sleeve 16 experiences during stretching is not permanent. It is further understood that the sleeve 16 may be permitted to retract in a variety of ways such as, for example, by grasping the knots 42 and 44 and guiding the sleeve 16 back to its relaxed configuration, or by letting go of the knots 42 and 44 and allowing the sleeve 16 to snap back to its relaxed configuration from its stretched configuration.

As a result of its retraction, the sleeve 16 now stores and retains a large amount, or a majority, of the cable 40 within the passage 18, and the cable 40 may easily be pulled out of the sleeve 16, via the end portion 16*a* and/or 16*b*, as required and/or desired.

Figure 11A:
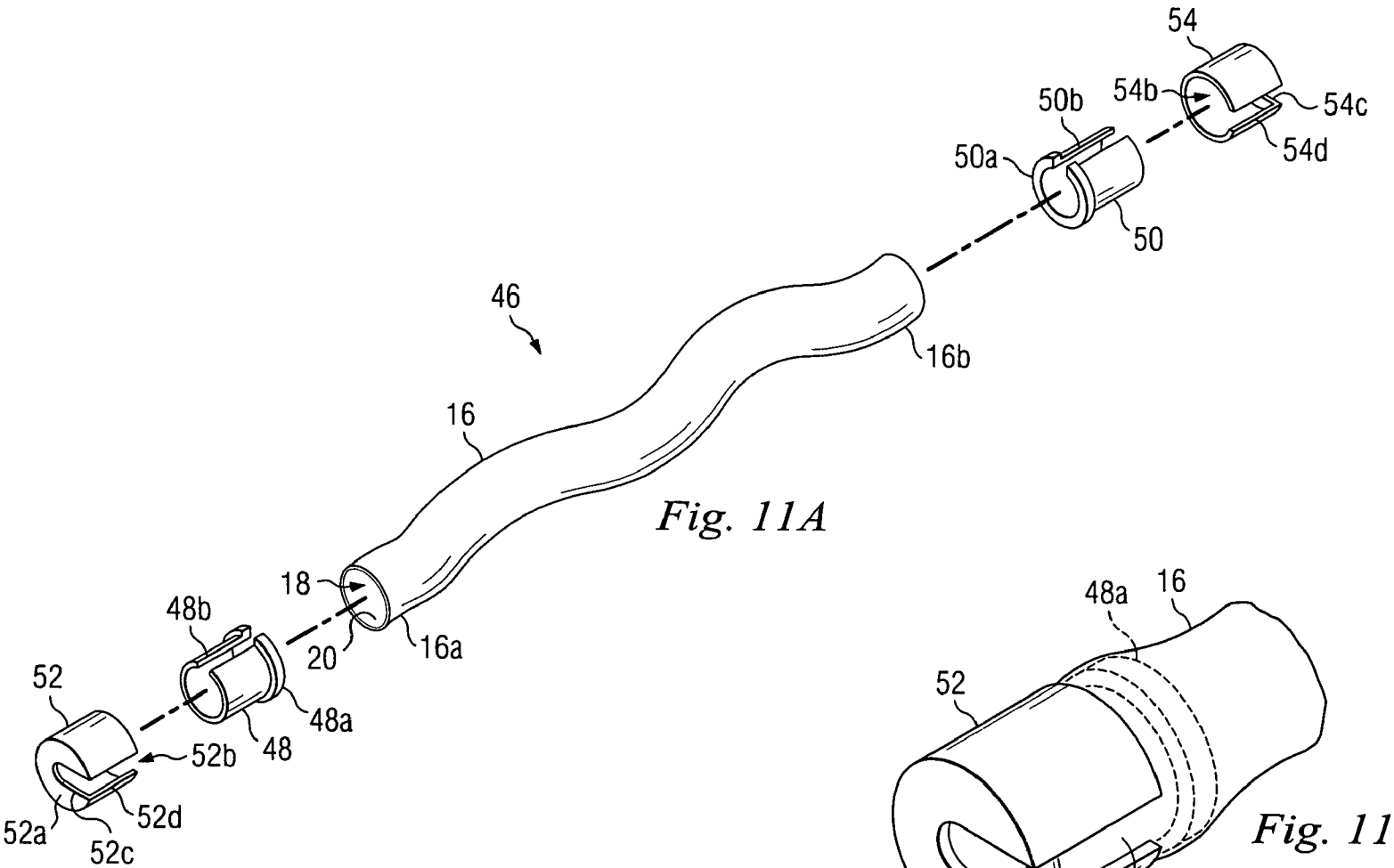
FIG. 11*a* is an exploded view of an apparatus according to another embodiment of the present invention.
Figure 11B:
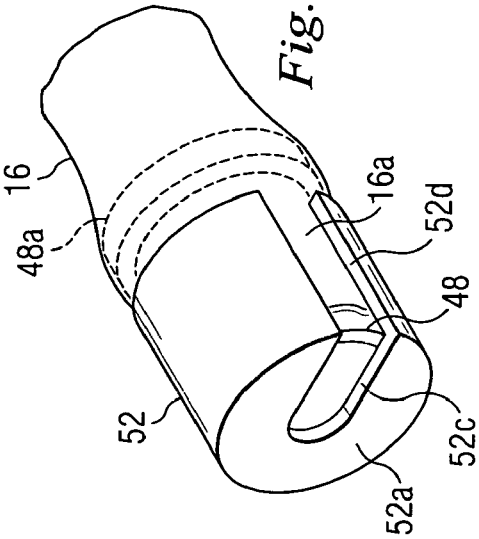
FIG. 11*b* is an enlarged view of an unexploded portion of the apparatus of FIG. 11*a*.

Referring to FIGS. 11*a* and 11*b*, an apparatus according to another embodiment of the present invention is generally referred to by the reference numeral 46. The embodiment of FIGS. 11*a* and 11*b* is similar to the embodiment of FIGS. 1 through 9 and contains several parts of the embodiment of FIGS. 1 through 9 which are given the same reference numerals. In the embodiment of FIGS. 11*a* and 11*b*, a pair of fittings 48 and 50 are adapted to engage the end portions 16*a* and 16*b*, respectively, of the sleeve 16. The fittings 48 and 50 include increased-diameter portions 48*a* and 50*a*, respectively, and longitudinally-extending slots 48*b* and 50*b*, respectively.

Fittings 52 and 54 are adapted to engage the fittings 48 and 50, respectively, and include end caps 52*a* and 54*a* that define cavities 52*b* and 54*b*, respectively (end cap 54*a* not shown). Radially-extending slots 52*c* and 54*c* are formed in the end caps 52*a* and 54*a*, respectively. Longitudinally-extending slots 52*d* and 54*d* are formed in the fittings 52 and 54, respectively, and intersect the slots 52*c* and 54*c*, respectively.

To assemble the apparatus 46, the fitting 48 is inserted into the passage 18 at the end portion 16*a* of the sleeve 16 so that the sleeve 16 fits over the increased-diameter portion 48*a*, circumferentially extending about and secured to the fitting 48, as shown in FIG. 11*b*. It is understood that a conventional connecting means may be used to further secure the fitting 48 to the sleeve 16 such as, for example, adhesive disposed between the fitting 48 and the internal surface 20 of the sleeve 16. The fitting 50 is inserted into the passage 18 at the end portion 16*b* of the sleeve 16 in a manner substantially identical to the foregoing.

The cavity 52*b* of the fitting 52 receives the fitting 48 and the end portion 16*a* of the sleeve 16 so that the fitting 52 surrounds the fitting 48 as shown in FIG. 11*b*. It is understood that the fitting 52 may apply a clamping-type force to the end portion 16*a*, and that adhesive or the equivalent may be disposed between the end portion 16*a* of the sleeve 16 and the walls of the fitting 52 defined by the cavity 52*b*. The fitting 54 engages the fitting 50 in a manner substantially identical to the foregoing.

It is understood that a line such as a cable (not shown) may be extended through the passage 18, the fittings 48 and 50, and the slots 52*c* and 54*c* of the fittings 52 and 54, respectively. It is further understood that the cable may be extended through the passage 18 before inserting the fittings 48 and 50 into the passage 18, in which case portions of the cable may be passed through the slots 48*b* and 50*b*, in a direction that is perpendicular to the longitudinal extension of the cable. Moreover, it is understood that the cable may be extended through the passage 18 and the fittings 48 and 50 before the fittings 52 and 54 receive the fittings 48 and 50, respectively, in which case portions of the cable may be passed through the slots 52*d* and 54*d*, in a direction that is perpendicular the longitudinal extension of the cable, so that, as a result, the cable longitudinally extends through the slots 52*c* and 54*c*. Passage of the cable through the slots 52*d* and 54*d*, prior to the receipt of the fittings 48 and 50 by the fittings 52 and 54, respectively, may prevent any unwanted interference between the end caps 52*a* and/or 52*b* and any plug element, receptacle, device, or the like that is connected to the cable.

The operation of the embodiment of FIGS. 11*a* and 11*b* is substantially similar to the operation of the embodiment of FIGS. 10*a* through 10*d* and therefore will not be described in detail except that, unlike the knots 42 and 44, the fittings 48, 50, 52 and 54 do not readily serve to promote the engagement between any cable that extends through the passage 18 and the internal surface 20 of the sleeve 16 in the vicinity of the end portions 16*a* and 16*b*.

Variations

It is understood that variations may be made in the foregoing without departing from the scope of the disclosure. For example, the sleeve 16 may be composed of any type of material suitable for elastic deformation such as, for example, any type of elastic material such as, for example, any type of rubber or elastomer. Also, the sleeve 16 may be in the form of any type of sleeve, jacket, sheath, tubing or the like.

Moreover, instead of the cable 12 or 40, the line may be in a wide variety of forms including but not limited to any type of cable including ribbon cable or twisted-pair cable, cable assembly, wire, wire assembly, cable harness assembly, cord, string, rope, twine, thread, braided bands and other types of bands, tape, tubing, tether, fabric, mesh, sheet, chain, or any combination thereof. The line may serve a wide variety of functions including but not limited to mechanical, electrical or electro-mechanical functions. Mechanical functionality includes but is not limited to the line serving as a pull-string or a tie-down component, or the line serving as a heat-sinking component. Electrical functionality includes but is not limited to signal and/or current-carrying functions, radio-frequency applications and digital electronics applications.

Also, it is understood that the mechanical, dimensional and physical properties of the line may be designed and/or selected in view of the mechanical, dimensional and physical properties of the sleeve 16, or vice versa, to promote optimum operation with respect to, for example, the collapsing of the line within the sleeve 16. In particular, the line may be specially designed to include a soft plastic component such as, for example, an outer jacket, that will not retain a stiff "memory," thereby enabling the line to easily collapse in a manner similar to that described above. It is further understood that the line may be "seasoned" or mechanically processed to further promote its collapse within the sleeve 16. For example, the line may be wound into a spiral in such a manner, prior to the operation of the sleeve 16 with respect to the line, so that the line exhibits a propensity to collapse in the form of a spiral within the sleeve 16.

Further, in addition to the power adapter 14 and the cell phone 30, the apparatus 10, 34 or 46 may be used in conjunction with one or more lines connected to and/or extending from all types of radio, electronic, electrical, mechanical, electromechanical or other types of devices in home, business, office or industrial settings including but not limited to routers, personal computers, industrial computers, window shades, window blinds, printers and other computer peripherals, personal digital assistants, communications devices, communication network equipment, audio equipment and video equipment. Also, the apparatus 10, 34 or 46 may be used with a line that is normally free and not connected to any type of device, or that is removably connected or connectable to any type of device.

Still further, the line does not have to be a single, individual line but instead may be composed of multiple lines extending through the sleeve 16. The multiple lines may themselves be surrounded by tubing such as heat-shrink tubing or, in the alternative, may be in the form of several, individually free lines.

Moreover, additional clips and/or other conventional types of hardware may be added to the apparatus 10, 34 or 46 to further secure the sleeve 16 to the cable 12 or 40, the power adapter 14, the cell phone 30 or any other device. Moreover, the cross-section of the sleeve 16 does not have to be circular and may instead be in the form of other shapes, such as rectangular shapes. Also, it is understood that the dimensions of the sleeve 16 may be varied including but not limited to the length and the cross-sectional area of the passage 18.

Further, it is understood that the fitting 24 and the clip 22 may be removed from the apparatus 10, that the splices 36*a*, 36*b*, 38*a* and 38*b* and the knots 42 and 44 may be removed from the apparatus 34, and that the fittings 48, 50, 52 and 54 may be removed from the apparatus 46.

Still further, it is understood that the apparatus 10, 34 or 46 may be provided as a kit including one or more components. If the apparatus 10, 34 or 46 is provided as a kit, some degree of assembly may be required prior to the operation of the apparatus 10, 34 or 46.

It is understood that one or more of the above-described embodiments and/or variations may be combined in whole or in part with any one or more of the other above-described embodiments and/or variations.

Any foregoing spatial references, such as "upper," "lower," "above," "below," "between," "vertical," "angular," etc., are for the purpose of illustration only and do not limit the specific orientation or location of the structure described above.

Although an exemplary embodiment of this invention has been described in detail above, those skilled in the art will readily appreciate that many other modifications are possible in the exemplary embodiment without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

What is claimed is:

1. Apparatus comprising:

a sleeve defining a passage through which a line is adapted to extend, the passage defining an internal surface of the sleeve;

wherein the sleeve comprises:

a first configuration in which the sleeve has a first length, and a first amount of the line is disposed within the passage when the line extends through the passage;

a second configuration in which the sleeve has a second length wherein the second length is greater than the first length; and a third configuration in which the line extends through the sleeve and at least a portion of the internal surface of the sleeve engages at least a portion of the line, and a second amount of the line is disposed within the passage wherein the second amount of the line is greater than the first amount of the line.

2. The apparatus of claim 1 wherein the sleeve has a third length in the third configuration, the third length ranging from a value substantially equal to about the first length to a value substantially equal to about the second length.

3. The apparatus of claim 1 wherein the passage has a first cross-sectional area at a location along the longitudinal length of the sleeve in the first configuration;

wherein the passage has a second cross-sectional area at the location along the longitudinal length of the sleeve in the second configuration; and wherein the second cross-sectional area is less than the first cross-sectional area.

4. The apparatus of claim 1 wherein the engagement between the internal surface of the sleeve and the line resists relative movement between the line and the sleeve.

5. The apparatus of claim 1 wherein the second amount of the line is substantially disposed within the passage when the line extends through the passage and the sleeve is in the second configuration.

6. The apparatus of claim 5 wherein the internal surface of the sleeve applies a force to the line to at least partially collapse the line to maintain the disposition of the second amount of the line substantially within the passage during the transition of the sleeve from the second to the third configuration.

7. The apparatus of claim 1 wherein the sleeve comprises a fourth configuration in which:

the line extends through the passage and at least another portion of the internal surface of the sleeve engages the line, and a third amount of the line is disposed substantially within the passage wherein the third amount substantially ranges from the first amount to the second amount.

8. The apparatus of claim 1 wherein the sleeve functions as packaging for the line in the third configuration.

9. The apparatus of claim 1 wherein the sleeve functions as a storage device for the line in the third configuration.

10. The apparatus of claim 1 further comprising a first fitting connected to a first end portion of the sleeve and through which the line is adapted to extend.

11. The apparatus of claim 10 further comprising a second fitting connected to a second end portion of the sleeve and through which the line is adapted to extend.

12. The apparatus of claim 1 wherein first and second knots are formed in first and second end portions, respectively, of the sleeve.

13. The apparatus of claim 1 further comprising the line.

14. The apparatus of claim 13 further comprising means for substantially fixing an end portion of the sleeve relative to the line when the line extends through the passage.

15. A method comprising:

extending a line through a sleeve having a first length so that a first amount of the line is disposed within the sleeve;

stretching the sleeve to a second length that is greater than the first length; and permitting the sleeve to retract to a third length that is less than the second length so that a second amount of the line is disposed within the sleeve wherein the second amount is greater than the first amount.

16. The method of claim 15 further comprising moving the line relative to the sleeve so that a third amount of the line is disposed within the sleeve wherein the third amount ranges from a value substantially equal to about the first amount to a value substantially equal to about the second amount.

17. The method of claim 15 wherein, after retraction, at least a portion of the sleeve is engaged with at least a portion of the line to resist relative movement between the line and the sleeve.

18. The method of claim 15 wherein the second amount of the line is substantially disposed within the sleeve when the sleeve has the second length.

19. The method of claim 18 wherein, during the step of permitting, the sleeve applies a force to the line to at least partially collapse the line to maintain the disposition of the second amount of the line substantially within the sleeve.

20. The method of claim 15 further comprising fixing an end portion of the sleeve relative to the line.

21. Apparatus comprising:

an elastic sleeve adapted to be stretched and permitted to retract, and through which a line is adapted to extend so that a first amount of the line is disposed within the elastic sleeve before the elastic sleeve is stretched and permitted to retract;

wherein, when the line extends through the elastic sleeve and after the elastic sleeve stretches and retracts, a second amount of the line is disposed within the elastic sleeve wherein the second amount is greater than the first amount.

22. The apparatus of claim 21 wherein, when the line extends through the elastic sleeve and after the elastic sleeve stretches and retracts, the elastic sleeve engages the line to resist relative movement between the line and the elastic sleeve.

23. The apparatus of claim 21 wherein the second amount of the line is substantially disposed within the elastic sleeve when the line extends through the elastic sleeve and the elastic sleeve has been stretched.

24. The apparatus of claim 23 wherein, when the line extends through the elastic sleeve and the elastic sleeve is retracting, at least a portion of the elastic sleeve applies a force to at least a portion of the line to collapse the line to substantially maintain the disposition of the second amount of the line substantially within the elastic sleeve.

25. The apparatus of claim 21 further comprising the line.

26. The apparatus of claim 25 further comprising means for substantially fixing an end portion of the elastic sleeve relative to the line.

* * * * *